US007449211B2

(12) United States Patent
Lee

(10) Patent No.: US 7,449,211 B2
(45) Date of Patent: Nov. 11, 2008

(54) BIO-SHEET MATERIAL AND ITS MANUFACTURING METHOD AND APPARATUS

(76) Inventor: Jong-Hak Lee, 104-1703, Mangpomaeulssangyong-Apartment, 691 Mangpo-Dong, Paldal-Ku, Suwon-City, Kyoungki-Do, 442-440 (KR)

( * ) Notice: Subject to any disclaimer, the term of this patent is extended or adjusted under 35 U.S.C. 154(b) by 0 days.

(21) Appl. No.: 11/439,663

(22) Filed: May 24, 2006

(65) Prior Publication Data

US 2006/0216405 A1 Sep. 28, 2006

Related U.S. Application Data

(62) Division of application No. 10/504,003, filed on Aug. 6, 2004, now abandoned.

(51) Int. Cl.

| | |
|---|---|
| ***B05D 3/02*** | (2006.01) |
| ***B05D 1/18*** | (2006.01) |
| ***A61F 13/00*** | (2006.01) |
| ***B05C 11/02*** | (2006.01) |
| ***B05C 11/08*** | (2006.01) |

(52) U.S. Cl. ..... 427/2.31; 427/2.3; 427/430.1; 427/443; 118/121; 118/200

(58) Field of Classification Search ..... 427/2.1, 427/2.31, 430, 372.2; 442/121, 123, 131
See application file for complete search history.

(56) References Cited

U.S. PATENT DOCUMENTS

| | | | | | |
|---|---|---|---|---|---|
| 2,175,399 | A | * | 10/1939 | Judd | 192/107 M |
| 3,526,573 | A | * | 9/1970 | Martello et al. | 442/232 |
| 3,575,134 | A | * | 4/1971 | Quint | 118/122 |
| 4,756,714 | A | * | 7/1988 | Hendrix et al. | 8/115.6 |
| 5,161,686 | A | * | 11/1992 | Weber et al. | 206/440 |

FOREIGN PATENT DOCUMENTS

| | | | |
|---|---|---|---|
| JP | 2-128831 | | 5/1990 |
| JP | H8-49153 | | 2/1996 |
| JP | 2000-59087 | | 2/2000 |
| JP | 2000-319414 | | 11/2000 |
| JP | 2002-20994 | | 1/2002 |
| KR | 2001070751 | A * | 7/2001 |

OTHER PUBLICATIONS

Official Action for Japanese Patent Application No. 2003-57863.

* cited by examiner

*Primary Examiner*—William P. Fletcher, III
*Assistant Examiner*—Cachet I Sellman
(74) *Attorney, Agent, or Firm*—Notaro & Michalos P.C.

(57) ABSTRACT

The present invention provides a bio-sheet material, and a method and an apparatus of manufacturing the bio-sheet, which has pliability or easiness of cutting by unifying a mixture of at least one of healthful natural minerals or plants such as ocher, jade, tourmalin, etc., using fiber material, paper, etc., as a medium, which can be maintained in an original shape at natural or heat drying without generating separation of the mixture, and which can shorten the manufacturing time.

2 Claims, 7 Drawing Sheets

BIO-SHEET MATERIAL AND ITS MANUFACTURING METHOD AND APPARATUS

CROSS REFERENCE TO RELATED APPLICATION

This is a divisional of U.S. patent application of Ser. No. 10/504,003 filed Aug. 6, 2004 now abandoned and incorporated here by reference.

TECHNICAL FIELD

The present invention relates to a bio-sheet material and its manufacturing method and apparatus, and more particularly to a bio-sheet material and a method and an apparatus of manufacturing the bio-sheet material which has functions such as blockage of harmful toxicity of cement, control of temperature or humidity, absorption of smell, antibacterial action, anti-mold, emission of ultrared ray, purification of air, blockage of electromagnetic waves, prevention from spreading of flame and emitting of toxic gas in a fire, etc., and which can be used as many purposes such as shoe soles, underlining and surface wallpaper for a ceiling, etc., interior fabric for various mats, beds, floor cushions, hygienic pads, diapers and bedclothes, etc.

BACKGROUND ART

Conventionally, there are developed sheets for realizing effects of ocher, etc., by providing ocher layers, etc., for wallpapers, pads, hygienic pads, etc. Such developed sheets using ocher, or other healthful mixture (gold, silver, copper, aluminium, charcoal, mugwort, tourmalin, white earth, jade, elvan stone, etc.,) are mostly manufactured by coating, or painting, the mixture on fiber material, wallpaper, etc.

However, such a manufacturing method has a problem in that, since the ocher or the mixture exists only on the fiber material or paper in case of being manufactured by the coating or the painting method, a layer of the ocher or the mixture is thin and effects of the ocher or the mixture can not be sufficiently achieved.

If the layer becomes thick, pliability or easiness of cutting in the sheet material, wallpapers, etc., is deteriorated and thus, the general purpose characteristic is also lowered.

Another problem is that the mixture layer is separated from the fiber material, paper, etc., after a long time has passed. That is, the ocher and/or its mixture becomes a different existence separated from the fiber material, paper, etc.

DISCLOSURE OF INVENTION

Accordingly, the present invention is made in order to solve the above problems, and one object of the present invention is to provide a bio-sheet material, and a method and an apparatus of manufacturing the bio-sheet, which has pliability or easiness of cutting by unifying a mixture of at least one of healthful natural minerals or plants such as ocher, jade, tourmalin, white earth, mugwort, charcoal, elvan stone, silver, zeolite, aluminium, copper, gold, etc., using fiber material, paper, etc., as a medium, which can be maintained in an original shape at natural or heat drying without separating the mixture from the fiber material, paper, etc., as far as physical force is not added although the bio-sheet material is dipped in water for a long time, and which can shorten the manufacturing time since the manufacturing method is not affected by air bubbles in ocher and its mixture and therefore the bio-sheet material can be used just after being mixed and then dried with no need to be riped for the air bubbles disappearing.

Considering an old ocher house, the ocher is painted in a mixture with straw as assistant material for unifying the ocher, thereby having purposes for improving the combining force of the ocher and lowering an extent of separation according to a time. The present invention makes up for the above-described disadvantages in the prior arts and modernizes the wisdom of ancestors who built the old ocher house.

To accomplish the object of this invention, a bio-sheet material is provided in accordance with one embodiment of a bio-sheet material of the invention, which is characterized in that front and rear first material layers are firmly combined as one body with a second material and a first material layer interior of the second material by preparing a first material, in which at least one of healthful natural minerals or plants such as ocher processed at a high temperature above 1,000 C or general ocher, jade, tourmalin, white earth, mugwort, charcoal, elvan stone, silver, zeolite, aluminum, copper, gold, etc., and a natural bonding agent extracted from natural raw material and/or binder of a synthetic polymer group are mixed, applying the first material thinly to opposite surfaces of, dipping and permeating the mixing material into, a second material or a pliable sheet of fiber material, paper, etc., in a plate shape or a roll shape, such as non-woven cloth, cotton cloth, gauze, etc., and, drying it. A color and a quality of a bio-sheet material, and levels in emission of ultrared rays or far infrared rays, control of a temperature and a humidity, absorption of electromagnetic waves, etc., can vary according to a kind or proportion of the first material.

Such a bio-sheet material of the present invention, in which at least one of ocher, jade, tourmalin, white earth, mugwort, charcoal, elvan stone, silver, zeolite, aluminium, copper, gold, etc., is mixed according to uses, has functions such as blockage of harmful toxicity of cement, control of temperature or humidity, absorption of smell, antibacterial action, anti-mold, emission of ultrared ray, purication of air, blockage of electromagnetic waves, prevention from spreading of flame and emitting of toxic gas in a fire, etc., and can be used as many purposes such as shoe soles, underlining and surface wallpaper for a ceiling, etc., interior fabric for various mats, beds, floor cushions, hygienic pads, diapers and bedclothes, etc., according to pliability, easiness of cutting and unifying force of the bio-sheet material, etc.

Further, a method of manufacturing a bio-sheet material is provided in accordance with one embodiment of a bio-sheet material manufacturing method of the invention, which is characterized by comprising the steps of preparing a first material in which at least one of healthful natural minerals or plants such as ocher processed at a high temperature above 1,000 C or general ocher, jade, tourmalin, white earth, mugwort, charcoal, elvan stone, silver, zeolite, aluminum, copper, gold, etc., and a natural bonding agent extracted from natural raw material and/or binder of a synthetic polymer group are mixed, applying the first material thinly to opposite surfaces of a second material or a pliable sheet of fiber material, paper, etc., in a plate shape or a roll shape, such as non-woven cloth, cotton cloth, gauze, etc., by dipping the second material in the mixing material, permeating the mixing material into the second material, and, drying the second material with the first material applied thereto and permeated thereinto at a temperature of 80-180 C on condition that the first material applied to the second material does not flow with no interference by at least external force, hot wind, etc., and to the extent that at least fluid and adhesion of the first material does not occur.

Still furthermore, an apparatus for manufacturing a bio-sheet material is provided in accordance with one embodiment of a bio-sheet material manufacturing apparatus of the invention, wherein front and rear first material layer are firmly combined as one body with a second material and a first material layer interior of the second material by preparing a first material in which at least one of healthful natural minerals or plants such as ocher processed at a high temperature above 1,000 C or general ocher, jade, tourmalin, white earth, mugwort, charcoal, elvan stone, silver, zeolite, aluminum, copper, gold, etc., and a natural bonding agent extracted from natural raw material and/or binder of a synthetic polymer group are mixed, applying the first material thinly to opposite surfaces of, dipping and permeating the mixing material into, a second material or a pliable sheet of fiber material, paper, etc., in a plate shape or a roll shape, such as non-woven cloth, cotton cloth, gauze, etc., and, drying it, said apparatus being characterized by comprising: a pair of thickness-control and mixture-leveling rollers (16,35,55,75) for making the thickness of the bio-sheet material constant and uniform by passing the second material with the first material through a constant gap right after thinly applying the first material to, and permeating the first material into, the second material; and, a first drying furnace (17,37*a*,57*a*,77*a*) for drying the second material with the first material applied thereto and permeated thereinto and with no interference at a temperature of 80 C to about 180 C on condition that the first material applied to the second material does not flow by not being interfered by at least external force, hot wind, etc., and to the extent that at least fluid and adhesion of the first material does not occur, right after passing a pair of thickness-control and mixture-leveling rollers (16,35,55,75).

Desirably, the thickness of the bio-sheet material becomes constant and uniform by passing the second material with the first material through a constant gap right after thinly applying the first material to, and permeating the first material into, the second material. It is also further desirable that the drying step under no interference is performed by drawing up the second material with the first material right after thinly applying the first material to, and permeating the first material into, the second material and drying it with an ultrared-ray ceramic heater, thereby removing effect on fluidity by an external force (gravitational force), air flow, etc., and reducing an installation area.

Also, it is desirable that the second material with the first material is completely dried by being raised and descended approximately in a V or U letter shape under hot wind circulation at a temperature of 50 C to about 120 C right after the drying step under no interference, thereby further improving spatial efficiency and performing drying deep of the second material with the first material. Meanwhile, it is desirable that the drying time is limited to a short time of 10 minutes and less so as not to destroy useful functions of ocher, etc.

BEST MODE FOR CARRYING OUT THE INVENTION

Now, preferred embodiments of the present invention will be described in detail with reference to the accompanying drawings.

Figure 1:
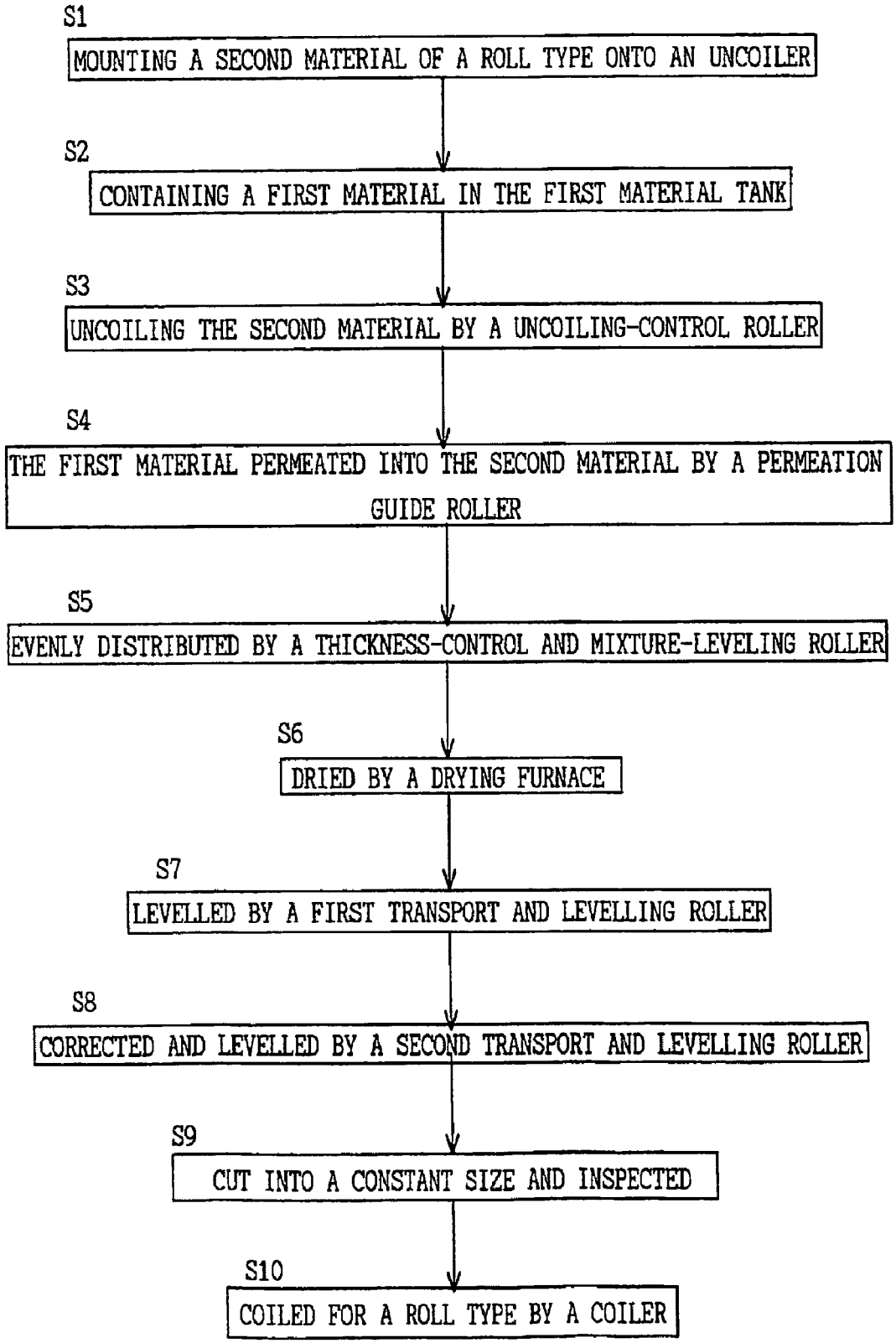
FIG. 1 is a general block diagram for explaining one embodiment of a method of manufacturing a bio-sheet material according to the present invention.
Figure 4:
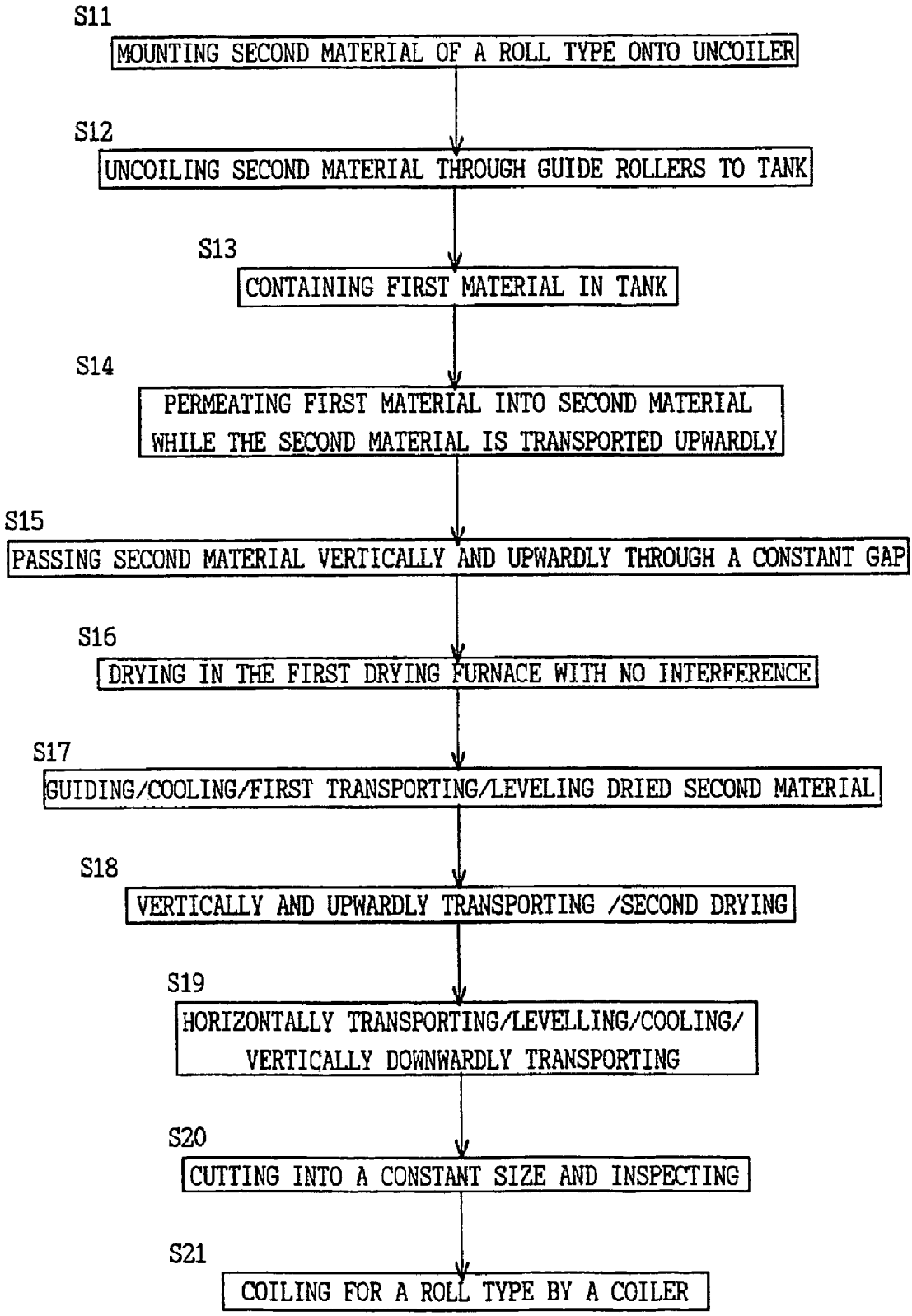
FIG. 4 is a general block diagram for explaining another embodiment of a method of manufacturing a bio-sheet material according to the present invention.

In FIGS. 1 and 4, general block diagrams for explaining embodiments of a method of manufacturing a bio-sheet material according to the present invention are illustrated.

Figure 3A:
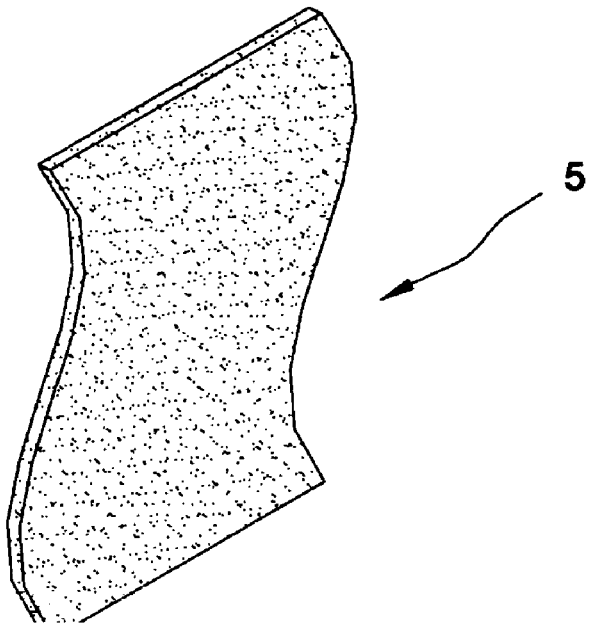
FIGS. 3*a* and 3*b* are perspective views illustrating the external shape of each bio-sheet material according to each embodiment of the present invention.
Figure 3B:
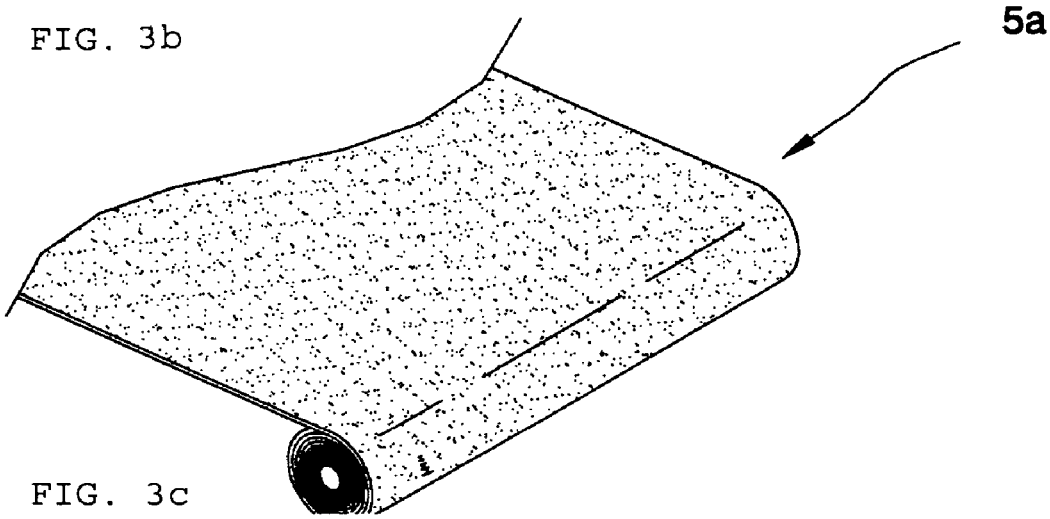
Figure 3C:
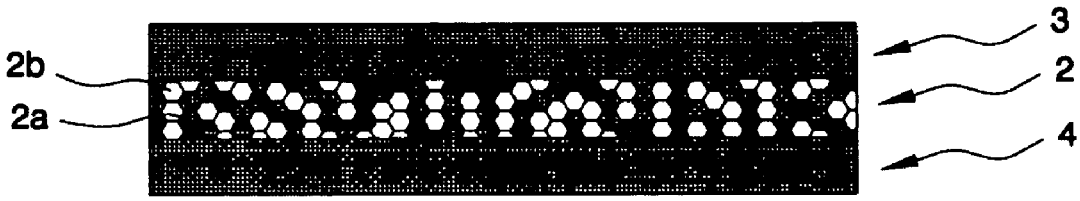
FIG. 3*c* is a partially-enlarged section view of the bio-sheet material.

First, a fundamental method of manufacturing a bio-sheet material in accordance with the invention is characterized by comprising the steps of preparing a first material (1) in which at least one of healthful natural minerals or plants such as ocher processed at a high temperature above 1,000 C or general ocher, jade, tourmalin, white earth, mugwort, charcoal, elvan stone, silver, zeolite, aluminum, copper, gold, etc., and a natural bonding agent extracted from natural raw material and/or binder of a synthetic polymer group are mixed, applying the first material (1) thinly to opposite surfaces of a second material (2) or a pliable sheet of fiber material, paper, etc., in a plate shape or a roll shape, such as non-woven cloth, cotton cloth, gauze, etc., by dipping the second material (2) in the mixing material or the first material (1), permeating the mixing material into the second material (2), and, drying the second material (2) with the first material (1) applied thereto and permeated thereinto at a temperature of 80 C to about 180 C on condition that the first material (1) applied to the second material (2) does not flow with no interference by at least external force, hot wind, etc., and to the extent that at least fluid and adhesion of the first material (1) does not occur. A binder (polyzol), corn starch, Macsumsuk (compound word of elvan stone and amphibole), ceramic powder, distilled water, other natural bonding material may be taken as examples of the natural bonding agent, and a schematic configuration of the bio-sheet material manufactured in such a manner is characterized in that front and rear first material layers (3,4) are firmly combined as one body with a second material (2) and a first material layer interior of the second material (2), as illustrated in FIG. 3*c*. Thus, the bio-sheet material has superior pliability and easiness of cutting, thereby being able to use as a general purpose. Also, the first material (1) of the mixture is not separated from the fiber material, paper, etc., as far as physical force is not added although the bio-sheet material is dipped in water for a long time, and the bio-sheet material can be maintained in an original shape at natural or heat drying, and thus any type of bonding is facilitated. And, since it is easy to bond the bio-sheet material with an adhesive agent of any purpose, the bio-sheet material can be used as many purposes such as underlining and surface wallpaper for a wall, a ceiling, etc., interior fabric for various mats, beds, floor cushions, hygienic pads, diapers and bedclothes, etc. Furthermore, contamination by the mixture does not occur, and the bio-sheet material has its own efficiencies.

Still furthermore, the second material (2) is dipped in the first material (1) and the first material (1) is permeated into the second material (2), which are not affected by air bubbles in ocher and its mixture. Therefore, the bio-sheet material can be used just after being mixed and dried with no need to be riped for the air bubbles disappearing and the manufacture time can be shortened.

Furthermore, the bio-sheet material can be manufactured with a thickness of approximately 0.2 to about 3 mm by such a method thereby having superior efficiencies such as blockage of harmful toxicity of cement, control of temperature or humidity, absorption of smell, antibacterial action, anti-mold, emission of ultrared ray, purication of air, blockage of electromagnetic waves, prevention from spreading of flame and emitting of toxic gas in a fire, etc. In particular, in case of being used as shoe soles, such a bio-sheet material has much effect described above such as superior absorption power of sweat or humidity, etc., thereby removing smell and having efficiencies for a foot health.

Meanwhile, although the bio-sheet material does not almost vary in a shape before or after processing, it varies in a color after processing according to a kind or proportion of the first material (1). For examples, a white color of a gauze or fiber texture, nonwoven fiber, etc., as the second material (2) before processing is changed to an ocher yellow color (in case of containing ocher), a grey color (in case of containing ceramic or elvan stone), a black color (in case of containing charcoal), a rat-grey color (in case of containing ocher, elvan stone, zeolite, ceramic, charcoal, etc.), a green-group color (in case of containing a mixture of a plant such as white earth, mugwort, etc., and ocher), a yellow color pink color flesh color (in case of containing ocher, white earth, jade, etc., and being changed according to their proportions), a pale yellow color (in case of containing bentonite, jade, etc.,) etc., thereby enabling manufacture of the bio-sheet material of various colors. Furthermore, it is desirable that, in case the proportion of mixing the natural adhesives and ocher, elvan stone, others (charcoal, etc.) is between 1:0.5 and 1:0.75, the bio-sheet material is used as lining paper or verious seat interior material, while in case the proportion of mixing the natural adhesives and ocher, elvan stone, ceramic, others (charcoal, etc.) is between 1:0.75 and 1:1, the bio-sheet material can be used as shoe soles.

In FIGS. 1, and 5 to 7, a schematical construction drawing for explaining embodiments of an apparatus for manufacturing a bio-sheet material according to the present invention are illustrated.

Figure 2:
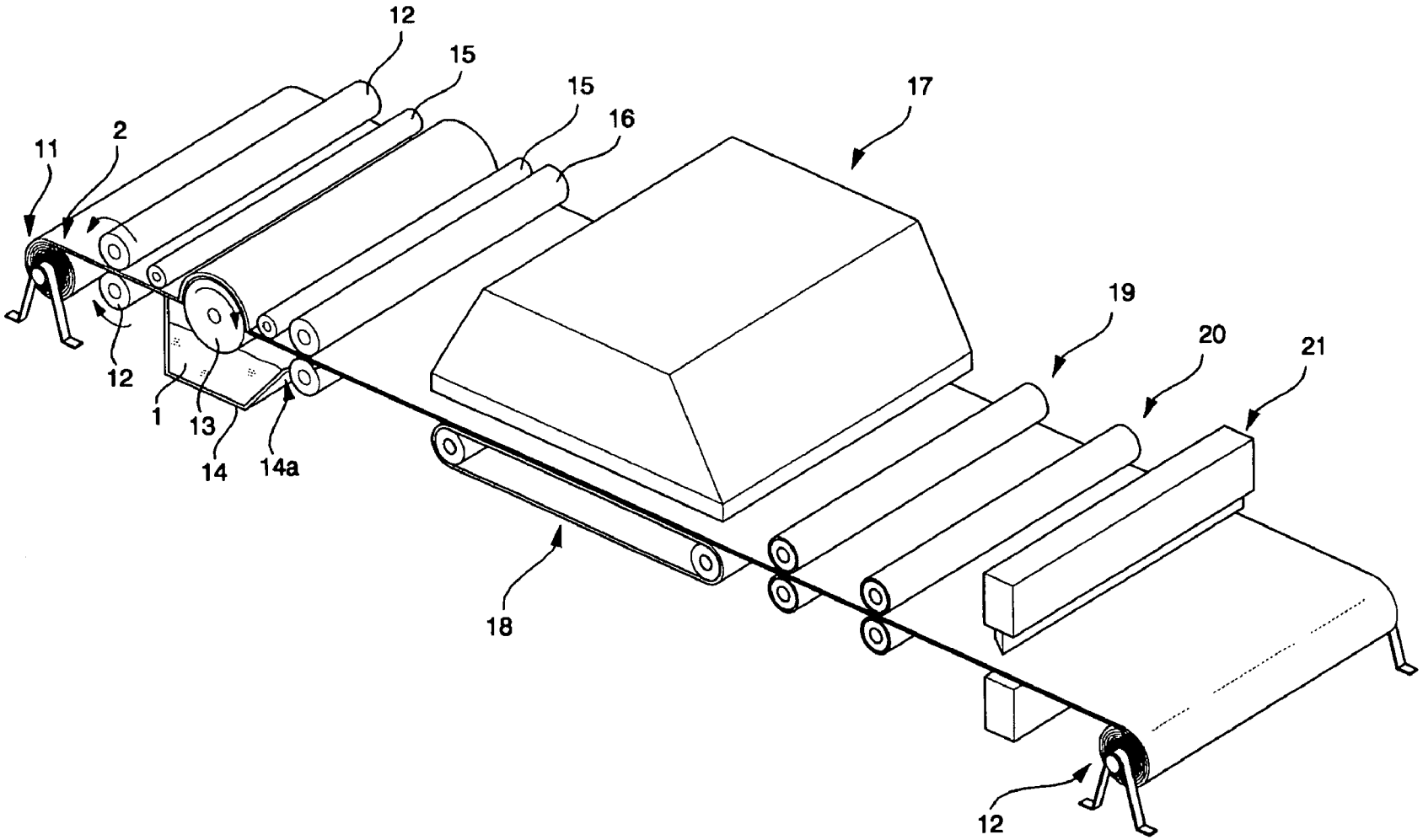
FIG. 2 is a schematical construction drawing for explaining one embodiment of an apparatus for manufacturing a bio-sheet material according to the present invention.

First, an apparatus manufacturing the bio-sheet material of the present invention with mass-production, as shown in FIG. 2, supplying means (11,12) for supplying the second material (2), a first material tank (14) for supplying the first material (1), a permeation guide roller (13), a pair of thickness-control and mixture-leveling rollers (16), a drying furnace (17), and, a pair of rear transportation and first leveling rollers (19) and/or a pair of second leveling rollers (20), said apparatus being capable of further comprising an inspection and cutting table (21) and a coiler (22).

The second material (2) is a pliable and porous sheet of fiber material, paper, etc., such as non-woven cloth, cotton cloth, gauze, etc. For supplying the second material (2) in a roll type, the supplying means comprises an uncoiler (11) and an uncoiling-control roller (12), as shown. For supplying the second material (2) in a plate shape, a palette, a pusher, etc., may be included, but not shown.

The first material tank (14) for supplying the first material (1) contains the first material (1), in which at least one of healthful natural minerals or plants such as ocher processed at a high temperature above 1,000 C or general ocher, jade, tourmalin, white earth, mugwort, charcoal, elvan stone, silver, zeolite, aluminum, copper, gold, etc., and a natural bonding agent extracted from natural raw material and/or binder of a synthetic polymer group are mixed with each other. Preferably, the extension part (14*a*), as shown in FIG. 2, may be comprised so that the remaining first material (1) flows into the main first material tank (14) after the thickness of the second material (2) with the first material (1) applied thereto and permeated thereinto is controlled by the thickness-control and mixture-leveling rollers (16).

As shown, the second material (2) is guided by and passed in contact with an upper part of the permeation guide roller (13) being rotated, and said permeation guide roller (13) is dipped in the first material tank (14) in a lower part, so as to dip the second material (2) in the first material (1) and to permeate the first material (1) into the second material (2). Also, the permeation guide roller (13) is not limited to such a construction, but can be contructed so as for the second material (2) to pass in contact with the lower part thereof, as in the after-mentioned embodiments.

Said pair of thickness-control and mixture-leveling rollers (16) are constructed so as to make the thickness of the bio-sheet material constant and uniform by passing the second material (2) with the first material (1) through a constant gap right after thinly applying the first material (1) to, and permeating the first material (1) into, the second material (2), and so as to return the remainding first material (1).

Furthermore, a front and/or rear assistant roller (15) may be additionally comprised after and/or before the permeation guidance roller (13) so as for the second material (2) to be transported exactly to the first material (1) for permeation.

As shown in FIG. 2, the rear transportation and first leveling rollers (19) may be provided for passing the second material (2) with the first material (1) through the first drying furnace (17) without any interference after the thickness-control and mixture-leveling rollers (16) without any guide roller, and/or the transportation conveyor (18) may be included for transporting the second material (2) with the first material (1) so as to completely dry it by passing it through the first drying furnace (17) without any relative movement after contacting into the conveyor. Also, the second leveling roller (20) may be further comprised for leveling a dried product.

Preferably, an inspection and cutting table (21) and a coiler (22) may be additionally included after the second leveling roller (20) so as to cut the dried product into a constant size, and inspect it for producing the dried and leveled bio-sheet material of a constant size.

A method of manufacturing the bio-sheet material by the above-mentioned apparatus for mass-production will be described in detail together with FIG. 1.

The preparing step is performed by mounting the second material (2) of a roll type onto the uncoiler (11) in step S1 and containing the first material (1) in the first material tank (14) in step S2, and then, when the apparatus is operated, the step of uncoiling the second material (2) from the roll with passing through the uncoiling-control roller (12) and controlling a transportation speed is performed (step S3).

Subsequently, the first material (1) contained in the first material tank (14) is permeated into the second material (2) by means of the permeation guide roller (13) with the second material (2) guided by means of the assistant rollers (15) after and/or before the step of permeating the first material so as for the second material (2) to be transported exactly to the first material (1) for permeation (in step S4). Then, in step S5, the first material (1) applied to the second material (2) is evenly distributed by means of the thickness-control and mixture-leveling roller (16) after the rear guiding step, and the remaining first material (1) after being controlled flows into the main first material tank (14) through the extension part (14*a*).

The second material (2) permeated and evenly distributed by the first material (1) is dried by passing through the drying furnace (17) properly maintained at a proper temperature using the rear transportation and first leveling rollers (19) or the transportation conveyor (18) in step S6, and is leveled by means of the first transport and leveling roller (19) and/or the second transport and leveling roller (20) after drying (step S7 and S8).

Then, in the inspection and cutting table (21), the dried product is cut into a constant size, and inspected for producing the dried and leveled bio-sheet material of a constant size (step S9). When the cutting is not necessary, only inspection is performed, and then, the production is completed by coiling the product on the coiler (22) for a roll type and wrapping it (step 10).

Figure 5:
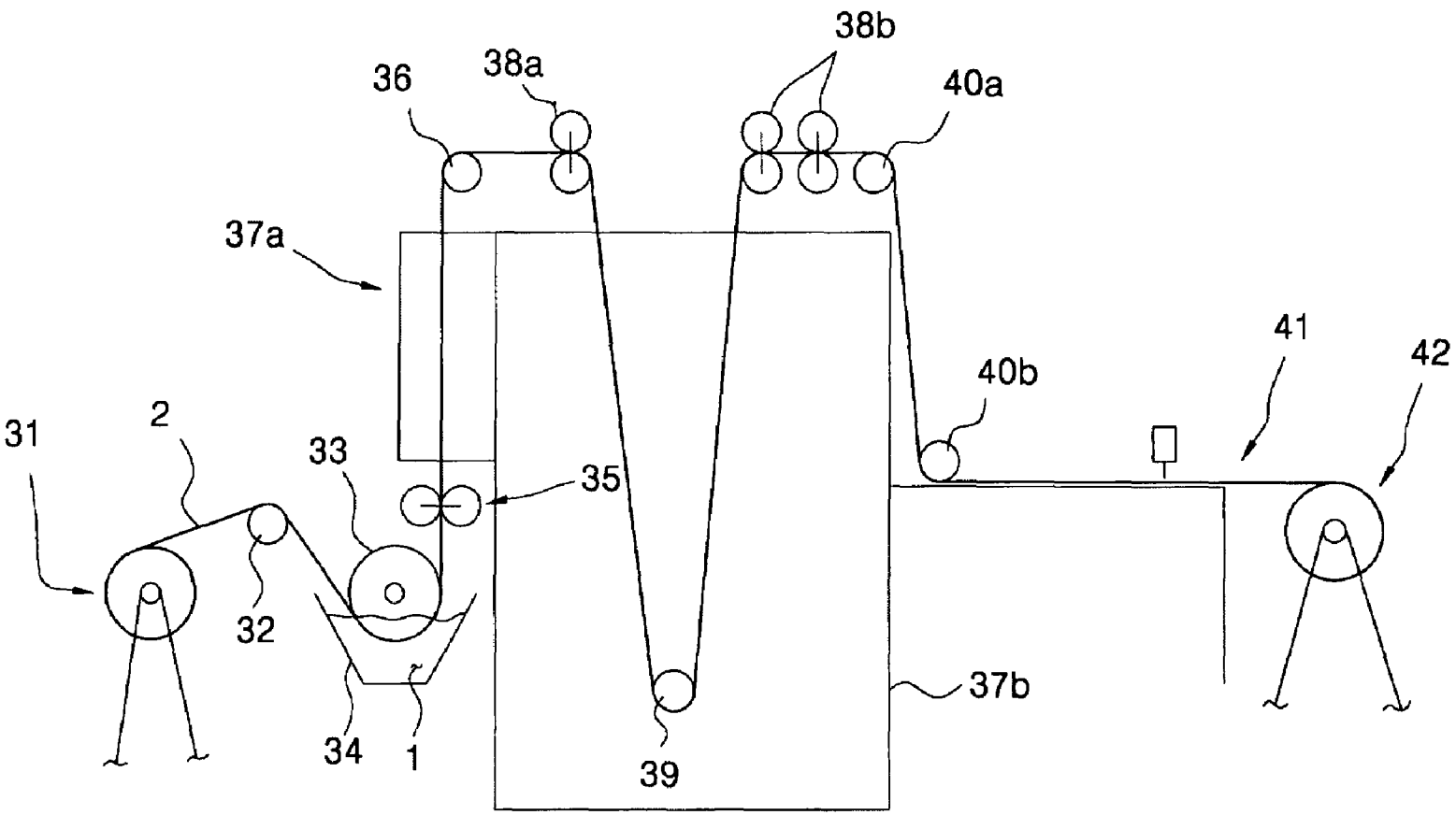
FIG. 5 is a schematical construction drawing for explaining another embodiment of an apparatus for manufacturing a bio-sheet material according to the present invention.
Figure 6:
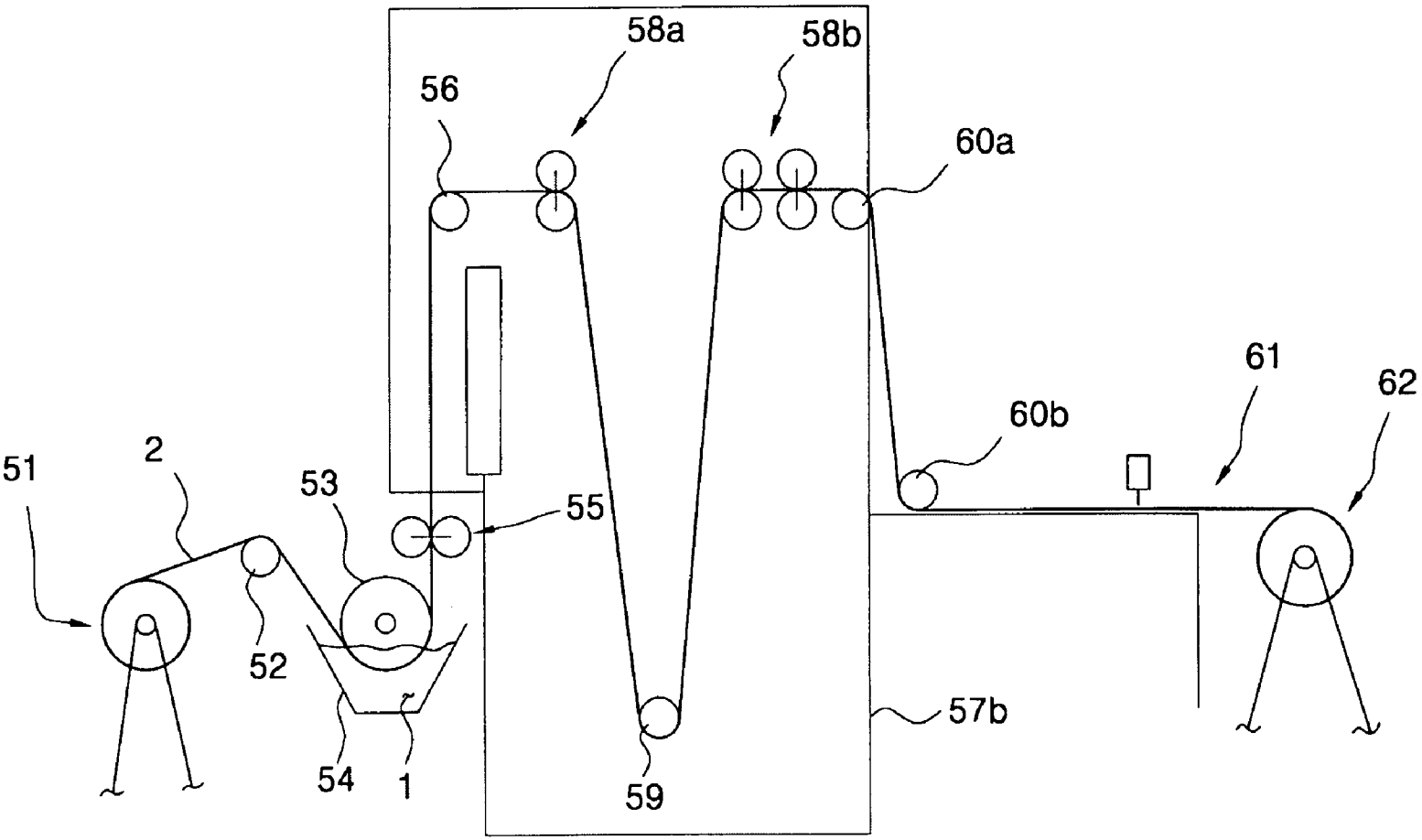
FIG. 6 is a schematical construction drawing for explaining further another embodiment of an apparatus for manufacturing a bio-sheet material according to the present invention.
Figure 7:
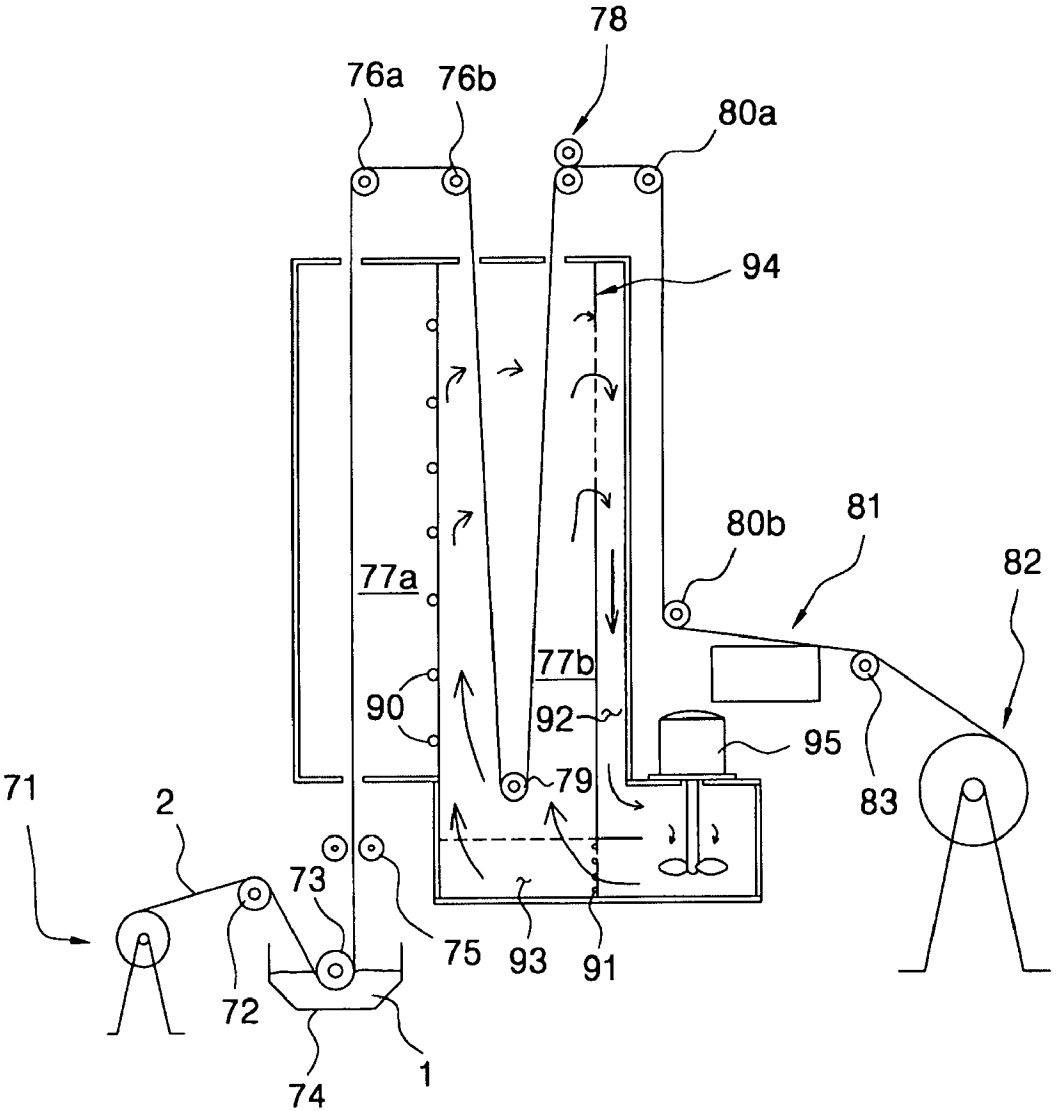
FIG. 7 is a schematical construction drawing for explaining still another embodiment of an apparatus for manufacturing a bio-sheet material according to the present invention.

The feature in the embodiments of the apparatus of the present illustrated in FIGS. 5 to 7, is to comprise a pair of upper transportation and leveling rollers (38*a*,58*a*) and/or a transportation roller (76*b*) for vertically drawing and transporting the second material (2) with the first material (1) by means of a guide roller (36,56,76*a*) so as to pass the first drying furnace (37*a*,57*a*,77*a*) without any interference. Also, an ultrared-ray ceramic heater (90) is installed in the first drying furnace (37*a*,57*a*,77*a*) for heating the second material (2) with the first material (1) so as to minimize interference by hot wind during the transportation.

A second drying furnace (37*b*,57*b*,77*b*) is provided for completely drying the second material (2) with the first material (1) by being raised and descended approximately in a V or U letter shape therein by means of the guide roller (39,59,79) and the transportation and leveling roller (38*b*,58*b*,78) arranged after the upper transportation and leveling rollers (38*a*,58*a*) and/or the transportation roller (76*b*). When a pair of transportation and leveling rollers are installed approximately before and after the V or U letter shape, the transportation speed can be maintained constant.

In FIG. 7, the second drying furnace (77*b*) is structured to circulate hot wind by comprising a partition wall (94) and a hot-wind circulation fan (95), by which the hot wind passing a heater (91) in a lower passage (93) flows up and then returns to a return room (92). The second furnaces (37*b*,57*b*) of FIGS. 5 and 6 can be similarly constructed in the hot-wind circulation structure.

Further, as in FIGS. 5 and 7, the guide roller (36,76*a*), the transportation and leveling rollers (38*a*,38*b*,78) and/or the transportation roller (76*b*) can be installed outside the drying furnace so as to cool the second material (2) with the first material (1) dried and combined and so as to facilitate removal of dust, etc., and maintenance, or can be installed inside as shown in FIG. 6 in order to prevent heat waste and increase drying efficiency. In the former case, it is possible to check at the middle whether the bio-sheet material is properly manufactured since the bio-sheet material is completely exposed before being dried completely.

A method of manufacturing the bio-sheet material by the above-mentioned apparatus having such a structural feature according another embodiments will be described in detail together with FIG. 4.

In step S11 to step S13, the preparing step is performed by mounting the second material (2) of a roll type onto the uncoiler (31,51,71), containing the first material (1) in the first material tank (34,54,74), uncoiling the second material (2) by the upper transportation and leveling rollers (38*a*,58*a*) and/or the transportation roller (76*b*) through the guide rollers (32,52,72) from the uncoiler (31,51,71) and winding a little the second material (2) to the coiler (42,62,82) with passing the whole line so as to enable transportation of the second material (2), and then, when the apparatus is operated, the step of uncoiling the second material (2) by the upper transportation and leveling rollers (38*a*,58*a*) and/or the transportation roller (76*b*) through the guide rollers (32,52,72) from the uncoiler (31,51,71), and then winding a little the second material (2) may be performed (step S12). Thus, in the uncoiler (31,51,71) of FIGS. 5 to 7, the second material (2) can be uncoiled by the upper transportation and leveling rollers (38*a*,58*a*) and/or the transportation roller (76*b*) with no need to control the speed.

Then, in step S14, the first material (1) contained in the first material tank (34,54,74) is permeated into the second material (2) by means of the permeation guide roller (33,53,73). That is, while the second material (2) is transported upwardly by the upper transportation and leveling rollers (38*a*,58*a*) and the transportation roller (76*b*) after passing a lower surface part of the permeation guide roller (33,53,73), the second material is dipped in the first material (1) in the tank, which is permeated into the second material through opposite surfaces of the second material (2). Just thereafter, in step 15, the second material (2) with the first material (1) is vertically and upwardly passed through a constant gap between the thickness-control and mixture-leveling rollers (35,55,75) for making the thickness of the bio-sheet material constant and uniform, and so that the remaining first material (1) flows into the lower first material tank. Preferably, the gap between the thickness-control and mixture-leveling rollers (35,55,75) is controlled so as to control a thickness of a bio-sheet material.

Subsequently, while the second material (2) with the first material (1) applied thereto and permeated thereinto and with the thickness controlled is vertically and upwardly transported, the second material (2) with the first material (1) applied thereto and permeated thereinto is dried in the first drying furnace (37*a*,57*a*,77*a*), particularly by the ultrared-ray ceramic heater with no interference at a temperature of 80 C to about 180 C (step S16). Thus, the first material (1) of the upper and lower bio-layers (3,4) does not flow because of being dried with no interference, and the uniform thickness formed by the thickness-control and mixture-leveling rollers (35,55,75) can be maintained constant as it is. Then, although the second material (2) with the first material (1) comes in contact with the guide rollers (36,56,76*a*), the first material (1) can not be separated from the second material (2) by being dried to the extent that at least fluid and adhesion of the first material (1) does not occur, and thus, inferior products are not generated in the upper and lower bio-layers (3,4) formed with the first material (1). In step S17, the second material (2) with the first material (1) continues being transported by means of the upper transportation and leveling rollers (38*a*,58*a*) and the transportation roller (76*b*) through the guide rollers (36, 56,76*a*), and leveling of the bio-sheet material can be achieved.

Furthermore, in steps S18 and S19, the second material (2) with the first material (1) is completely dried by being raised and descended approximately in a V or U letter shape by means of the guide rollers (39,59,79) under hot wind circulation at a temperature of 50 C to about 120 C, and then is passed through the transportation and leveling roller (38*b*, 58*b*,78) in the upper portion of the second drying furnace (37*b*,57*b*,77*b*), thereby being leveling and improving spatial efficiency. In FIG. 7, the hot wind passing through the heater (91) in the lower passage (93) of the second drying furnace (77*b*) flows up for drying the first material (1) which is applied to, and permeated into, the second material (2), and then returns to the return room (92) for circulation by operation of the hot-air circulation fan (95). Thus, drying efficiency can be increased and drying even a deep inside of the bio-sheet material is facilitated, thereby obtaining stabilization of the product. However, it is desirable that the drying time is limited to a short time of 10 minutes and less so as not to destroy useful functions of ocher, etc.

Then, the dried bio-sheet material is horizontally transported by means of the guide rollers (40*a*,40*b*,60*a*,60*b*,80*a*, 80*b*) and, in the inspection and cutting table (41,61,81), the dried product is cut into a constant size, and inspected for producing the dried and leveled bio-sheet material of a constant size (step S20). When the cutting is not necessary, only inspection is performed, and then, the production is completed by coiling the product on the coiler (42,62,82) for a roll type of the bio-sheet material (5*a*) as shown in FIG. 3*b* and wrapping it (step 21). Even in this case, the sectional structure of the bio-sheet material is as explained above in connection with FIG. 3*c*.

By virtue of the configuration and acting of the bio-sheet material and its manufacturing method and apparatus in accordance with the embodiments of the present invention described above, at least one of healthful natural minerals or plants such as ocher, jade, tourmalin, white earth, mugwort, charcoal, elvan stone, silver, zeolite, aluminium, copper, gold, etc., and one of fiber material, paper, etc., are unified as the bio-sheet material so as to have functions such as blockage of harmful toxicity of cement, control of temperature or humidity, absorption of smell, antibacterial action, anti-mold, emission of ultrared ray, purication of air, blockage of electromagnetic waves, prevention from spreading of flame and emitting of toxic gas in a fire, etc., and thus the bio-sheet material has pliability or easiness of cutting and is maintained in an original shape at natural or heat drying without generating separation of the mixture from the fiber material, paper, etc., as far as physical force is not added although the bio-sheet material is dipped in water for a long time. Therefore, the bio-sheet material can be used as many purposes such as shoe soles, underlining and surface wallpaper for a ceiling, etc., interior fabric for various mats, beds, floor cushions, hygienic pads, diapers and bedclothes, etc., and the manufacturing time can be shorten since the manufacturing method is not affected by air bubbles in ocher and its mixture and therefore the bio-sheet material can be used just after being mixed and dried with no need to be riped for removing the air bubbles.

The invention claimed is:

1. A method of manufacturing a bio-sheet material, said method comprising the steps of:

preparing a first material (1) by mixing together a material selected from the group consisting of: natural minerals, plants, ocher processed at a high temperature above 1,000 C, ocher, jade, tourmalin, white earth, mugwort, charcoal, elvan stone, silver, zeolite, aluminum, copper, and gold, and a bonding agent selected from the group consisting of: an extract from natural raw material and a binder of a synthetic polymer group:

dipping a second material (2) in the first material (1) so as to permeate the first material into the second material (2) and to apply the first material (1) thinly to opposite surfaces of the second material (2), the second material (2) being one of non-woven cloth, cotton cloth or gauze;

evenly distributing the first material (1) applied to, and permeated into, the second material (2) using a pair of thickness-control and mixture-leveling rollers (35,55, 75) so as to make an overall thickness of the second material (2) with the first material (1) constant and uniform between about 0.2 mm and 3 mm, and so as to return the remaining first material (1), by vertically and upwardly passing the second material (2) with the first material (1) through a constant gap of the pair of thickness-control and mixture-leveling rollers (35,55,75) after the dipping step;

drying the second material (2) with the first material (1) applied thereto and permeated thereinto in a first drying step at a temperature of 80~180 degrees C. while vertically and upwardly transporting the second material (2) with the first material (1) in a first drying furnace (37*a*, 57*a*,77*a*) on condition that the first material (1) does not flow by being subjected to no interference by external force and the overall thickness can be maintained constant during the first drying step, and to the extent that at least fluid and adhesion of the first material (1) does not occur so that, although the second material (2) with the first material (1) comes in contact with guide rollers (36,56,76*a*) and upper transportation and leveling rollers (38*a*,58*a*), the first material (1) can not be separated from the second material (2);

transporting and leveling the second material (2) with the first material (1) by passing the second material (2) with the first material (1) through the upper transportation and leveling rollers (38*a*,58*a*) after the first drying step; and completely drying the second material (2) with the first material (1) in a second drying step by descending and raising it approximately in a V or U letter shape under hot wind circulation at a temperature of 50~120 degrees C. in a second drying furnace (37*b*,57*b*,77*b*) after the transporting and leveling step.

2. A method of manufacturing a bio-sheet material according to claim 1, wherein the bio-sheet material is manufactured through mass-production steps which further comprise the steps of:

mounting the second material (2) which is in the form of a roll onto an uncoiler (11), containing the first material (1) in a first material tank (14), and uncoiling the second material (2) from the roll through a uncoiling-control roller (12), before the dipping step;

guiding the second material (2) using an assistant roller (15) one of after and before the permeation step for the second material (2) to be transported exactly to the first material (1) for permeation; and further transporting and leveling the dried second material (2) together with the first material (1) by passing the second material (2) with the first material (1) through transportation and leveling rollers (38*a*,38*b*,78) after the second drying step.

* * * * *